United States Patent [19]

Berthold et al.

[11] Patent Number: 4,987,059

[45] Date of Patent: Jan. 22, 1991

[54] PROCESS FOR STABILIZING PHOTOGRAPHIC SILVER IMAGES

[75] Inventors: Werner Berthold; Helmut Häseler; Paul Marx, all of Leverkusen; Heinz Meckl; Hans Öhischläger, both of Bergisch Gladbach, all of Fed. Rep. of Germany

[73] Assignee: AGFA-Gevaert Aktiengesellschaft, Leverkusen, Fed. Rep. of Germany

[21] Appl. No.: 438,743

[22] Filed: Nov. 17, 1989

[30] Foreign Application Priority Data

Dec. 1, 1988 [DE] Fed. Rep. of Germany ..... 3840489

[51] Int. Cl.[5] ..... G03C 5/24

[52] U.S. Cl. ..... 430/428; 430/429; 430/463; 430/963

[58] Field of Search ..... 430/428, 429, 463, 963

[56] References Cited

U.S. PATENT DOCUMENTS

| | | | |
|---|---|---|---|
| 3,598,588 | 8/1971 | Meckl et al. | 430/432 |
| 3,718,468 | 2/1973 | Berthold et al. | 430/429 |
| 4,760,015 | 7/1988 | Berthold et al. | 430/428 |
| 4,886,737 | 12/1989 | Berthold et al. | 430/428 |

*Primary Examiner*—Paul R. Michl
*Assistant Examiner*—Thomas R. Neville
*Attorney, Agent, or Firm*—Connolly & Hutz

[57] ABSTRACT

Excellent image silver stability is obtained without intermediate washing after fixing and without a special finishing bath by a process for stabilizing a silver image produced by exposure, development and fixing of a photographic material containing at least one silver halide emulsion layer, in which, immediately after fixing, the photographic material is subjected to treatment by a stabilizing bath containing a compound corresponding to general formula (I)

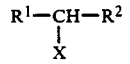

in which

X=Cl, Br $R^1$=H, $C_{1-4}$ alkyl, $C_{6-10}$ aryl, $R^2$=CHO, COOH, COONa, $CH_2COOH$, $CH_2COONa$, $CONR_2^3$, $CONHR^3$, $R^3$=H, $C_{1-2}$ alkyl, and a compound corresponding to formula II

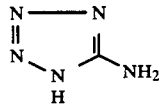

and/or to formula III

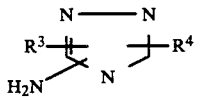

III in which $R^3$ and $R^4$ may be the same or different and represent H, —$NH_2$, alkyl, alkenyl, cycloalkyl, aryl, alkoxy, alkylthio, alkylsulfonyl, sulfamoyl, acyl, —SH or a heterocyclic group.

7 Claims, No Drawings

PROCESS FOR STABILIZING PHOTOGRAPHIC SILVER IMAGES

INTRODUCTION

This invention relates to a process for stabilizing photographic silver images by treatment with a stabilizing bath.

BACKGROUND OF THE INVENTION

In photographic processing, the unexposed silver halide is usually complexed with alkali or ammonium thiosulfates after development and more or less thoroughly removed by subsequent washing. The completeness with which the silver thiosulfate complexes are removed is determined by the duration and temperature of this treatment step and by the support used for the photographic layer, for example baryta paper, polyethylene-laminated paper or cellulose acetate, polyester or the like for film. On average, it takes at least 30 minutes' washing at approximately 25° C., although thiosulfates can still remain behind. In this case, patchiness can occur during the storage of the silver images, because the image gradually changes hue either completely or locally from black to brown or yellow. This is attributable to the formation of silver sulfide formed by the decomposition of the residual thiosulfate.

A similar troublesome change in image hue occurs when photographic silver images are exposed to the effect of oxidizing gases. Oxidation of the image silver results in the formation of water-soluble silver salts which can diffuse in the material. The photolysis of these soluble silver salts results in the formation of finely divided yellow to red-brown colored colloidal silver or, alternatively, brown colored silver compounds are formed. These troublesome changes frequently occur in the final photographic silver image in the form of so-called microspot defects.

There has been no shortage of attempts to avoid or reduce these troublesome subsequent changes in the photographically produced silver images, for example by washing the chemicals required for the processing of the exposed photographic recording materials more thoroughly or by storing the processed recording materials, i.e. the final silver images, under standardized atmospheric conditions.

Various processes have been described with a view to reducing the washing time and avoiding the adverse effects of the thiosulfate impurities. One useful method of converting residual thiosulfate into photographically harmless compounds is to use monochlorine or monobromine compounds, such as for example chloroacetic acid in accordance with DE-A-1 522 428. In an after-treatment bath which contains the monochlorine or monobromine compound mentioned above and which follows the shortened washing step, the thiosulfates are converted into the corresponding salt of a thiosulfuric acid S ester known as Bunte's salt.

These compounds are no longer able to react as thiosulfates with the image silver. However, it was not possible completely to dispense with the washing following the fixing step as long as baryta paper or other papers without a plastic coating were used as supports. By contrast, final washing can be dispensed with altogether if plastic-coated papers, such as for example polyethylene-coated paper or acetyl cellulose in the case of film, are used as support for the photographic layer.

In order to counteract harmful environmental influences in the form of oxidizing gases, various classes of compounds have already been proposed for stabilizing silver images, generally being used in additional finishing baths after the final washing bath.

The compounds in question include non-cyclic or cyclic thiosemicarbazides (DE-A-20 00 622), heterocyclic mercapto or thione compounds of the tetrahydropyrimidine, thiazine or tetrazine type (DE-A-20 13 423), organic and inorganic thiocyanates (DE-A-22 18 387) and isothioureas (U.S. Pat. No. 4,500,632). However, these compounds do not satisfy practical requirements because their stabilizing effect is inadequate or because the photographic properties of the layers are undesirably influenced.

Other processes are known in which stabilizing additives are directly incorporated in the photographic silver halide material. Thus, DE-A-31 51 182 (GB-A-2,090,991) describes the incorporation of polyvinyl imidazole while GB-A-1,156,167 describes the incorporation of sulfoalkyl-substituted hydroquinones.

However, relatively high concentrations of 0.5 g/m$^2$ heave to be used in their case to obtain adequate stabilization. The compatibility of the polyvinyl imidazole itself with silver halide emulsions, with wetting agents, stabilizers, developers and auxiliary developers is extremely critical. In addition, high concentrations in the protective layer lead to a reduction in gloss.

A process for stabilizing photographically produced silver images which obviates the disadvantages mentioned above has now been found which eliminates the need for washing after fixing in the case of plastic-coated photographic paper and which uses a stabilizing bath containing both an aliphatic monochlorine compound or monobromine compound and an aminotetrazole or amino-1,2,4-triazole in certain quantities as stabilizing compounds.

SUMMARY OF THE INVENTION

The present invention relates to a process for stabilizing a silver image produced by exposure, development and fixing of a photographic material containing at least one silver halide emulsion layer, characterized in that, immediately after fixing, the photographic material is subjected to treatment by a stabilizing bath containing a compound corresponding to general formula (I)

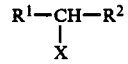

in which

X=Cl, Br $R^1$=H, $C_{1-4}$ alkyl, $C_{6-10}$ aryl, $R^2$=CHO, COOH, COONa, $CH_2COOH$, $CH_2COONa$, $CONR^3_2$, $CONHR^3$, $R^3$=H, $C_{1-2}$ alkyl, a compound corresponding to formula II

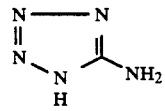

and/or to formula III

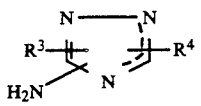

III in which $R^3$ and $R^4$ may be the same or different and represent H, —$NH_2$, alkyl, alkenyl, cycloalkyl, aryl, alkoxy, alkylthio, alkylsulfonyl, sulfamoyl, acyl, —SH or a heterocyclic group.

Water-soluble aliphatic monochlorine compounds, such as chloroacetic acid, chloroacetaldehyde, chloroacetamide and β-chloropropionic acid, and water-soluble derivatives thereof in the form of salts and amides are preferably used in this process.

In formula III, an alkyl group represented by $R^3$ or $R^4$ may be linear or branched and may preferably contain 1 to 4 carbon atoms. Examples are methyl, ethyl, isopropyl. An alkyl group such as this may also be substituted, for example by hydroxyl, alkoxy, alkylthio, carboxyl, carbalkoxy or amino. An alkenyl group is, for example, vinyl or allyl. A cycloalkyl group is, for example, cyclohexyl. An aryl group is, for example, phenyl which may optionally be substituted, for example by halogen, alkoxy, alkythio, acylamino or nitro.

The alkoxy, alkylthio or alkylsulfonyl groups represented by $R^3$ or $R^4$ preferably contain alkyl radicals containing up to 4 carbon atoms; preferred examples are methoxy, methylthio, methylsufonyl. A sulfamoyl group is, for example, N,N-dimethylsulfamoyl. An acyl radical is preferably derived from an aliphatic carboxylic acid containing up to 4 carbon atoms; acetyl is one example of such an acyl radical.

A heterocyclic group represented by $R^3$ or $R^4$ is, in particular, a furyl or pyridyl group.

DESCRIPTION OF PREFERRED EMBODIMENT

In one preferred embodiment, the amino-1,2,4-triazole corresponds to one of the following formulae IV and V:

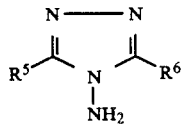

IV

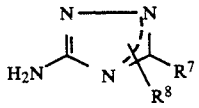

V in which $R^5$, $R^6$ may be the same or different and represent H, —$NH_2$, alkyl, aryl or alkylthio;

$R^7$ has the same meaning as $R^6$ or represents —SH, $R^8$ represents H, alkyl, aryl or —X—$R^9$, X represents —CO—, —CS— or —$SO_2$— and $R^9$ represents alkyl, alkenyl, cycloalkyl, aryl or an amino group.

The following are suitable examples of the amino-1,2,4-triazoles (AT) used in accordance with the invention:

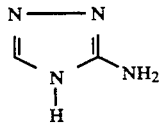

AT-1

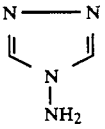

AT-2

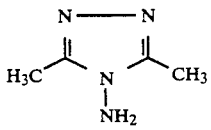

AT-3

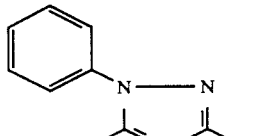

AT-4

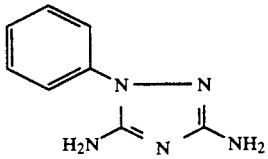

AT-5

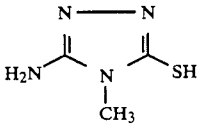

AT-6

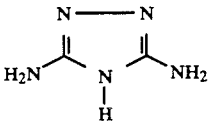

AT-7

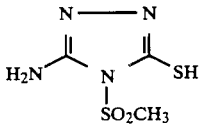

AT-8

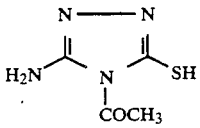

AT-9

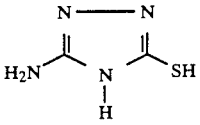

AT-10

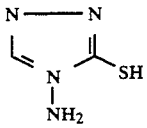

AT-11

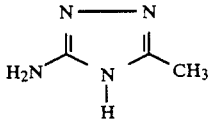

AT-12

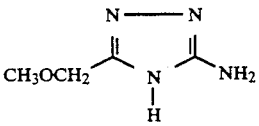

AT-13

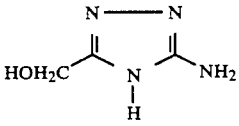

AT-14

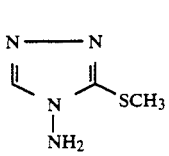

AT-15

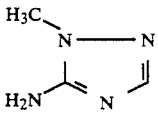

AT-16

-continued

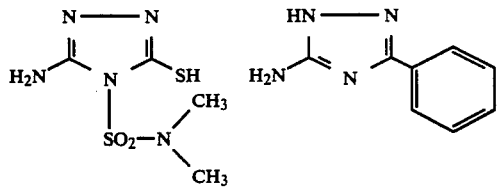

AT-17 AT-18

The amino-1,2,4-triazoles used in accordance with the invention are known. A review of their production, physical properties and tautomerization ratios can be found in The Chemistry of Heterocyclic Compounds, John Wiley & Sons, New York, Volume 37, 1981.

Aminotetrazoles are described by F. R. Benson in Heterocyclic Compounds, Ed. R. C. Elderfield, Wiley, New York, 1967, Volume 8.

When the monochlorine or monobromine compounds are combined with aminotetrazole or with an amino-1,2,4-triazole of formula III in a stabilizing bath, it is surprising that excellent silver image stability is obtained without intermediate washing after fixing and without a special finishing bath. The use of the monochlorine compound or monobromine compound on its own necessitates an aftertreatment bath in cases where improved image silver stability to oxidizing gases is to be obtained at the same time.

In the most simple case, the stabilizing bath according to the invention consists of a solution of the stabilizing compounds. Aqueous solutions are preferred, although solutions in organic solvents or in solvent mixtures of water and organic solvents, such as aliphatic alcohols, dimethyl formamide or the like, may also be used. To improve the solubility of aqueous solutions, the pH value of the solution may be raised or lowered, for example with KOH or with $H_2SO_4$.

The concentration of the monochlorine or monobromine compound used in the stabilizing bath is in the range from 0.5 to 100 g/l and preferably in the range from 10 to 20 g/l while the concentration of the aminotetrazole or amino-1,2,4-triazole corresponding to formula III is in the range from 2 to 30 g/l and preferably in the range from 10 to 20 g/l.

The process according to the invention may be used for any photographic silver images irrespective of the particular method used for their production. For example, silver images conventionally produced by development and fixing of an exposed photographic material can be stabilized. The images may be standard half-tone images or copies from the graphic field or films.

Finished silver images, i.e. silver images which have been photographically obtained by development or activation of an exposed photographic recording material containing silver halide, are subjected to the stabilizing process according to the invention, processing after the development step comprising a stabilizing treatment stage in which the unexposed silver halide is removed.

This treatment stage may comprise, for example, subjecting the developed photographic recording material, which already contains the silver image, but also residual silver halide, to a typical fixing treatment, for example in a processing bath containing an alkali thiosulfate or ammonium thiosulfate, the silver halide being dissolved out of the recording material in the form of soluble silver complex salt. A "stable" silver image is produced in this way, of which the stability is attributable to the fact that the unexposed areas are substantially free from photosensitive silver halide and which is referred to in the present context as the finished silver image.

The aftertreatment bath according to the invention may contain further additives, such as wetting agents, pH-modifying agents and antioxidants, for example an alkali metal sulfite or a hydroxylamine salt.

The silver image photographically produced by any process is stabilized by the aftertreatment bath according to the invention so that it is less sensitive to external influences during subsequent storage, more especially to the effect of oxidizing gases and thiosulfate residues. The occurrence of this stabilizing effect is also largely independent of the particular type of photographic recording material used to produce the silver image providing it contains at least one photosensitive silver halide emulsion layer and is developed by a black-and-white development process.

The photosensitive silver halide emulsions used in the recording material may contain as halide chloride, bromide and iodide or mixtures thereof. In one preferred embodiment, 0 to 12 mol-% of the halide component of at least one layer consists of iodide, 0 to 50 mol-% of chloride and 50 to 100 mol-% of bromide. The silver halide generally consists of predominantly compact crystals which may have, for example, a regular cubic or octahedral form or transitional forms. They may be characterized in that they mostly have a thickness of more than 0.2 μm. The average diameter-to-thickness ratio is preferably less than 8:1, the diameter of a crystal being defined as the diameter of a circle with an area corresponding to the projected area of the crystal. In another preferred embodiment, however, all the emulsions or individual emulsions may also contain substantially silver halide crystals in which the diameter-to-thickness ratio is greater than 8:1. The emulsions may be monodisperse or even heterodisperse emulsions which preferably have a mean grain size of 0.3 μm to 1.2 μm. The silver halide grains may have a multi-layer grain structure.

Suitable protective colloids or binders for the layers of the recording material are any of the usual hydrophilic film-forming agents, for example proteins, particularly gelatine. However, the gelatine may be completely or partly replaced by other natural or synthetic binders. Casting aids and plasticizers may be used, cf. Research Disclosure 17 643 (December, 1978), more especially Chapters IX, XI and XII.

The emulsions may be chemically and/or spectrally sensitized in the usual way and may contain silver halide stabilizers. The emulsion layers and other non-photosensitive layers may be hardened in the usual way with known hardeners. Suitable chemical sensitizers, spectral sensitizing dyes, stabilizers and hardeners are described, for example, in Research Disclosure 17 643, cf. in particular Chapters III, IV, VI and X.

The recording materials subjected to the stabilizing process according to the invention are exposed to form an image, ultraviolet light, visible light or infrared light or even high-energy radiation being used for exposure. Exposure is followed by typical processing to convert the exposed silver halide into image silver, for which purpose the recording material is treated in the presence of a silver halide developer compound, which may be present in one of the layers of the recording material or in an aqueous treatment beth, generally in the alkaline medium. Inorganic or organic developer compounds may be used, examples being hydroquinone, 3-pyrazolidone, aminophenol and derivatives thereof, cf. Research Disclosure 17 643, Chapter XX. In general, development is followed by treatment in a fixing bath to dissolve the unexposed and undeveloped silver halide out of the recording material.

The stabilizing process according to the invention is most effective when used as the final treatment step before drying of the black-and-white image. This also means that the stabilizing bath according to the invention is preferably not followed by any further treatment with liquids, particularly washing. However, it is also possible for the stabilizing bath according to the invention to be followed by very brief washing to reduce the surface concentration of salts from the stabilizing bath to improve gloss.

EXAMPLES

Samples in the form of grey step wedges of polyethylene-coated black-and-white papers based on silver bromide containing 1.5 g/$AgNO_3$ per $m^2$ were developed for 60 s at room temperature in a black-and-white phenidone-hydroquinone paper developer, subsequently treated for 30 s in a stop bath consisting of 2% by weight acetic acid and then fixed for 5 minutes in a black-and-white fixing bath based on ammonium thiosulfate.

The comparison samples (Examples 1 to 9) were then washed for 15 minutes in running water, the thiosulfate being completely removed. The samples were then either dried (Example I) or additionally subjected to an after-treatment bath containing substances which protect the silver image against the effect of oxidizing gases, for example amino-1,2,4-triazole or 5-aminotetrazole in various concentrations (Examples 2 to 9).

In contrast to the preceding samples, another comparison sample (Example 10) was then wiped after fixing and not washed, but instead was bathed for 3 minutes in a 1% by weight aqueous solution of the sodium salt of monochloroacetic acid, subsequently stripped and dried without further washing.

The samples processed in accordance with the invention (Examples 11 to 18) were also not washed after fixing, but wiped and placed for 3 minutes in a bath which, in addition to a 1% by weight solution of the sodium salt of chloroacetic acid, also contained aminotriazole or aminotetrazole in various concentrations. The samples were then wiped and dried.

Testing of samples 11 to 18 produced in accordance with the invention for residual thiosulfate showed that no more residues of thiosulfate were present after 4 days.

All samples were tested for their stability to the effect of oxidizing gases, in the present case peroxides. To this end, the samples were suspended in a closed, aquarium-like vessel which stands in daylight at room temperature and which contains small dishes filled with 3% by weight hydrogen peroxide uniformly distributed over its base. Solid sodium percarbonate may be used instead of hydrogen peroxide providing a relative air humidity of 84% is simultaneously established with saturated potassium bromide solution. However, it takes longer in this case for the silver image to be affected and for differences to be recognized.

The series of samples of Examples 1 to 18 (see Table 1) were stored over liquid hydrogen peroxide for 13 days as described above and then evaluated, see Table 2.

Another series of samples of Examples 19 to 34 (see Table 3) was prepared under the same processing conditions, except that a paper based on silver chloride bromide (containing 1.5 g $AgNO_3$ per $m^2$, 70 mol-% chloride) was used instead of a commercially available black-and-white paper based on silver bromide. By virtue of the better silver stability of silver bromide papers, this series of samples was stored over liquid hydrogen peroxide for 26 days under the storage conditions described above. This series was evaluated on the basis of the same criteria and marks, cf. Table 4.

TABLE 1

| Examples | Washing | Aftertreatment bath: Aqueous monochloroacetic acid sodium salt solution [% by weight] | Aqueous aminotriazole solution [% by weight] | Aqueous aminotetrazole solution [% by weight] |
|---|---|---|---|---|
| 1 Comparison | + | — | — | — |
| 2 Comparison | + | — | 0.5 | — |
| 3 Comparison | + | — | 1.0 | — |
| 4 Comparison | + | — | 2.0 | — |
| 5 Comparison | + | — | 3.0 | — |
| 6 Comparison | + | — | — | 0.5 |
| 7 Comparison | + | — | — | 1.0 |
| 8 Comparison | + | — | — | 2.0 |
| 9 Comparison | + | — | — | 3.0 |
| 10 Comparison | — | 1.0 | — | — |
| 11 Invention | — | 1.0 | 0.5 | — |
| 12 Invention | — | 1.0 | 1.0 | — |
| 13 Invention | — | 1.0 | 2.0 | — |
| 14 Invention | — | 1.0 | 3.0 | — |
| 15 Invention | — | 1.0 | — | 0.5 |
| 16 Invention | — | 1.0 | — | 1.0 |
| 17 Invention | — | 1.0 | — | 2.0 |
| 18 Invention | — | 1.0 | — | 3.0 |

TABLE 2

| Example No. | Mark | Remarks |
|---|---|---|
| 1 | 5 | Light steps faded, medium steps heavily discolored to brown |
| 2 | 5 | Medium steps faded and heavily discolored to brown |
| 3 | 4 | Medium steps faded and discolored to brown |
| 4 | 3–4 | Medium steps heavily faded |
| 5 | 2–3 | Medium steps partly faded |
| 6 | 5 | Light steps heavily faded, medium steps heavily discolored to brown |
| 7 | 5 | Light steps heavily faded, medium steps |

TABLE 2-continued

| Example No. | Mark | Remarks |
|---|---|---|
| | | heavily discolored to brown |
| 8 | 4 | Medium steps faded and discolored to brown |
| 9 | 2 | Light steps, incipient fading |
| 10 | 5 | Medium and dark steps heavily discolored to brown |
| 11 | 4 | Medium and dark steps discolored to brown |
| 12 | 2 | Medium steps locally light brown |
| 13 | 1 | Unchanged |
| 14 | 1 | Unchanged |
| 15 | 2 | Medium steps locally light brown |
| 16 | 1 | Unchanged |
| 17 | 1 | Unchanged |
| 18 | 1 | Unchanged |

TABLE 3

| Examples | Washing | Aftertreatment bath: Aqueous monochloroacetic acid sodium salt solution [% by weight] | Aqueous aminotriazole solution [% by weight] | Aqueous aminotetrazole solution [% by weight] |
|---|---|---|---|---|
| 19 Comparison | + | — | — | — |
| 20 Comparison | + | — | 0.5 | — |
| 21 Comparison | + | — | 1.0 | — |
| 22 Comparison | + | — | 2.0 | — |
| 23 Comparison | + | — | 3.0 | — |
| 24 Comparison | + | — | — | 0.5 |
| 25 Comparison | + | — | — | 1.0 |
| 26 Comparison | + | — | — | 2.0 |
| 27 Comparison | + | — | — | 3.0 |
| 28 Comparison | — | 1.0 | — | — |
| 29 Invention | — | 1.0 | 0.5 | — |
| 30 Invention | — | 1.0 | 1.0 | — |
| 31 Invention | — | 1.0 | 2.0 | — |
| 32 Invention | — | 1.0 | 3.0 | — |
| 33 Invention | — | 1.0 | — | 0.5 |
| 34 Invention | — | 1.0 | — | 1.0 |

TABLE 4

| Example No. | Mark | Remarks |
|---|---|---|
| 19 | 5 | Heavy fading and discoloration |
| 20 | 3 | Medium steps discolored and incipient fading |
| 21 | 2 | Medium steps incipient discoloration |
| 22 | 1–2 | Light steps traces of discoloration |
| 23 | 1–2 | Light steps traces of discoloration |
| 24 | 3 | Medium and dark steps discolored |
| 25 | 2 | Dark steps slightly discolored to brown |
| 26 | 3 | Light steps faded |
| 27 | 4 | Light and medium steps discolored and faded |
| 28 | 5 | Medium and dark steps heavily faded |
| 29 | 2 | Locally incipient discoloration |
| 30 | 2 | Light steps, incipient fading |
| 31 | 3 | Light steps, fading |
| 32 | 3 | Light steps, fading |
| 33 | 1 | Unchanged |
| 34 | 1 | Unchanged |

Explanation of the marking system
1 = unchanged silver image
2 = image locally slightly discolored to brown or incipient fading
3 = image locally heavily discolored to brown
4 = locally faded image
5 = destruction of image by fading or discoloration As can be seen from the Tables, the best silver image stability is achieved in the samples which were processed in accordance with the invention in a bath containing the sodium salt of monochloroacetic acid and, at the same time, the stability-improving additives, aminotriazole or aminotetrazole, in suitable concentrations.

We claim:

1. A process for stabilizing a silver image produced by exposure, development and fixing of a photographic material containing at least one silver halide emulsion layer, characterized in that, immediately after fixing and in the absence of washing the photographic material is subjected to treatment by a stabilizing bath containing a compound corresponding to general formula (I)

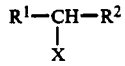

in which

X=Cl, Br $R^1$=H, $C_{1-4}$ alkyl, $C_{6-10}$ aryl, $R^2$=CHO, COOH, COONa, $CH_2COOH$, $CH_2COONa$, $CONR^3_2$, $CONHR^3$, $R^3$=H, $C_{1-2}$ alkyl, and a compound corresponding to formula II

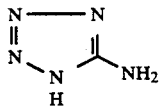

and/or to formula III

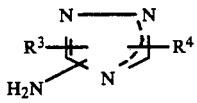

III in which $R^3$ and $R^4$ may be the same or different and represent H, —$NH_2$, alkyl, alkenyl, cycloalkyl, aryl, alkoxy, alkylthio, alkylsulfonyl, sulfamoyl, acyl, —SH or a heterocyclic group.

2. A process as claimed in claim 1, characterized in that the compound corresponding to formula I is chloroacetic acid or its sodium salt.

3. A process as claimed in claim 1, characterized in that the compound corresponding to formula I is chloroacetamide.

4. A process as claimed in claim 1, characterized in that the stabilizing bath contains compounds corresponding to formula I in a concentration of 0.5 to 100 g/l.

5. A process as claimed in claim 1, characterized in that the stabilizing bath contains aminotetrazole in a concentration of 2 to 30 g/l.

6. A process as claimed in claim 1, characterized in that the amino-1,2,4-triazole corresponds to one of the following formulae IV and V

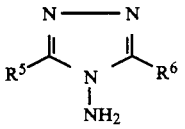

IV

-continued

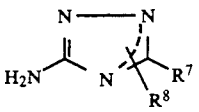

V in which $R^5$ and $R^6$ may be the same or different and represent H, —$NH_2$, alkyl, aryl or alkylthio, $R^7$ has the same meaning as $R^6$ or represents —SH, $R^8$ represents H, alkyl, aryl or —X—$R^9$, X represents —CO—, —CS— or —$SO_2$— and $R^9$ represents alkyl, alkenyl, cycloalkyl, aryl or an amino group.

7. A process as claimed in claim 1, characterized in that the stabilizing bath contains the aminotetrazole corresponding to formula II or the amino-1,2,4-triazoles corresponding to formula III in a quantity of 2 to 30 g/l.

* * * * *